US009077068B2

(12) United States Patent
Wong et al.

(10) Patent No.: US 9,077,068 B2
(45) Date of Patent: Jul. 7, 2015

(54) COMMUNICATION DEVICE AND ANTENNA SYSTEM THEREIN

(75) Inventors: Kin-Lu Wong, Kaohsiung (TW); Tsung-Ju Wu, Kaohsiung (TW)

(73) Assignee: ACER INCORPORATED, Taipei Hsien (TW)

( * ) Notice: Subject to any disclaimer, the term of this patent is extended or adjusted under 35 U.S.C. 154(b) by 296 days.

(21) Appl. No.: 13/599,059

(22) Filed: Aug. 30, 2012

(65) Prior Publication Data

US 2013/0342425 A1 Dec. 26, 2013

(30) Foreign Application Priority Data

Jun. 22, 2012 (TW) ..... 101122355 A

(51) Int. Cl.

| | |
|---|---|
| ***H01Q 7/00*** | (2006.01) |
| ***H01Q 1/22*** | (2006.01) |
| ***H01Q 1/38*** | (2006.01) |
| ***H01Q 1/48*** | (2006.01) |
| ***H01Q 1/52*** | (2006.01) |
| ***H01Q 9/42*** | (2006.01) |
| ***H01Q 21/28*** | (2006.01) |
| ***H01Q 21/30*** | (2006.01) |
| ***H01Q 5/20*** | (2015.01) |

(52) U.S. Cl.

CPC ..... *H01Q 1/2266* (2013.01); *H01Q 1/38* (2013.01); *H01Q 1/48* (2013.01); *H01Q 1/521* (2013.01); *H01Q 9/42* (2013.01); *H01Q 21/28* (2013.01); *H01Q 21/30* (2013.01); *H01Q 5/20* (2015.01)

(58) Field of Classification Search

USPC ..... 343/700 MS, 702

See application file for complete search history.

(56) References Cited

U.S. PATENT DOCUMENTS

| | | | | |
|---|---|---|---|---|
| 6,686,886 | B2 * | 2/2004 | Flint et al. | 343/702 |
| 7,274,340 | B2 * | 9/2007 | Ozden et al. | 343/860 |
| 7,298,339 | B1 | 11/2007 | Ollikainen | |
| 7,417,591 | B2 * | 8/2008 | Iguchi et al. | 343/702 |
| 7,825,863 | B2 * | 11/2010 | Martiskainen et al. | 343/702 |
| 2006/0181468 | A1 | 8/2006 | Iguchi et al. | |
| 2007/0001911 | A1 * | 1/2007 | Fujio et al. | 343/700 MS |
| 2007/0052591 | A1 | 3/2007 | Chao | |

FOREIGN PATENT DOCUMENTS

| | | |
|---|---|---|
| CN | 1925221 | 3/2007 |
| EP | 0 548 975 | 6/1993 |

(Continued)

OTHER PUBLICATIONS

European Search Report dated Nov. 4, 2013.

(Continued)

*Primary Examiner* — Hoang V Nguyen
*Assistant Examiner* — Hai Tran
(74) *Attorney, Agent, or Firm* — McClure, Qualey & Rodack, LLP

(57) ABSTRACT

A communication device including a supporting plate and an antenna system is provided. The supporting plate includes a conductive plate and a non-conductive plate. The conductive plate has a first edge and a second edge. The antenna system includes at least two antennas, which are both disposed at the first edge of the conductive plate and operate in at least a first band. A distance between the first edge and the second edge of the conductive plate is about 0.25 wavelength of the lowest frequency in the first band, and the distance is smaller than a length of the first edge.

12 Claims, 4 Drawing Sheets

(56) References Cited

FOREIGN PATENT DOCUMENTS

| | | |
|---|---|---|
| EP | 1 294 048 | 3/2003 |
| TW | I336975 | 2/2011 |
| TW | 201216558 | 4/2012 |
| WO | WO 2012/077406 | 6/2012 |

OTHER PUBLICATIONS

Taiwanese language office action dated Mar. 18, 2015, issued in TW Application No. 101122355, 2015.

* cited by examiner

COMMUNICATION DEVICE AND ANTENNA SYSTEM THEREIN

CROSS REFERENCE TO RELATED APPLICATIONS

This Application claims priority of Taiwan Patent Application No. 101122355 filed on Jun. 22, 2012, the entirety of which is incorporated by reference herein.

BACKGROUND OF THE INVENTION

1. Field of the Invention

The disclosure generally relates to a communication device, and more particularly, relates to a communication device comprising a MIMO (Multi-Input and Multi-Output) antenna system with high isolation.

2. Description of the Related Art

As people demand more and more data transmission, related communication standards are supporting higher and higher data transmission rates. For example, IEEE 802.11n can support MIMO technology to increase transmission rates. The related communication standards, such as LTE (Long Term Evolution), also support MIMO operations. As a matter of fact, it is a future trend to use multiple antennas in a mobile device. However, since multiple antennas are to be disposed in a limited space of a mobile device, the isolation between these antennas is an important factor to be considered.

Traditionally, the method for improving isolation and for reducing mutual coupling between MIMO antennas is to dispose an isolation element between two adjacent antennas, wherein the resonant frequency of the isolation element is approximately equal to that of the antennas so as to decrease the mutual coupling between the antennas. The drawbacks of the traditional method include decreased antenna efficiency and degraded radiation performance. In addition, if these antennas are operated in an LTE 700 band (from 704 MHz to 787 MHz), the isolation element is required to resonate at about 700 MHz and hence requires a large element size, which greatly increases the size of the whole antenna system. Integration of such an antenna system in the limited space inside the mobile device is a challenge for an antenna designer.

Accordingly, there is a need to provide a new communication device which performs MIMO operations without any isolation element but has good isolation. The antenna efficiency of the antenna system in the communication device should not be affected, or should even be enhanced.

BRIEF SUMMARY OF THE INVENTION

The invention is aimed to provide a communication device comprising an antenna system. The antenna system comprises at least two antennas and is located at an edge of a supporting plate. The communication device of the invention has high isolation without any isolation element between these antennas in the antenna system, and the antenna efficiency is generally maintained.

In an embodiment, the disclosure is directed to a communication device, comprising: a supporting plate, comprising a conductive plate and a non-conductive plate, wherein the conductive plate has a first edge and a second edge, and the second edge is opposite to the first edge and is adjacent to the non-conductive plate; and an antenna system, disposed at the first edge, and at least comprising: a first antenna, operating in at least a first band; and a second antenna, operating in at least the first band, wherein a distance between the first edge and the second edge is approximately equal to 0.25 wavelength of the lowest frequency in the first band, and the distance is smaller than a length of the first edge.

Generally speaking, the distance between the first edge and the second edge of a traditional conductive plate is much greater than 0.25 wavelength of the lowest frequency in the first band. In comparison to the traditional design, the novel supporting plate of the invention can effectively improve the current distribution on the conductive plate, thereby reducing surface currents along the first edge of the conductive plate. Since the mutual coupling between the antennas is dominated by the surface currents along the first edge of the conductive plate near the antenna system, the distance between the first edge and the second edge of the conductive plate is designed to be approximately 0.25 wavelength of the lowest frequency in the first band, and the compound supporting plate comprising the non-conductive plate and the conductive plate is integrated with the antenna system. The invention not only maintains robustness of the supporting plate but also reduces the coupling between the antennas, thereby improving the isolation between the antennas.

In an embodiment, the isolation (S21) of the antenna system in the first band may be improved by 15 dB or more, to be about −28 dB (S21), but the radiation efficiency of the antenna system generally does not decrease.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1:
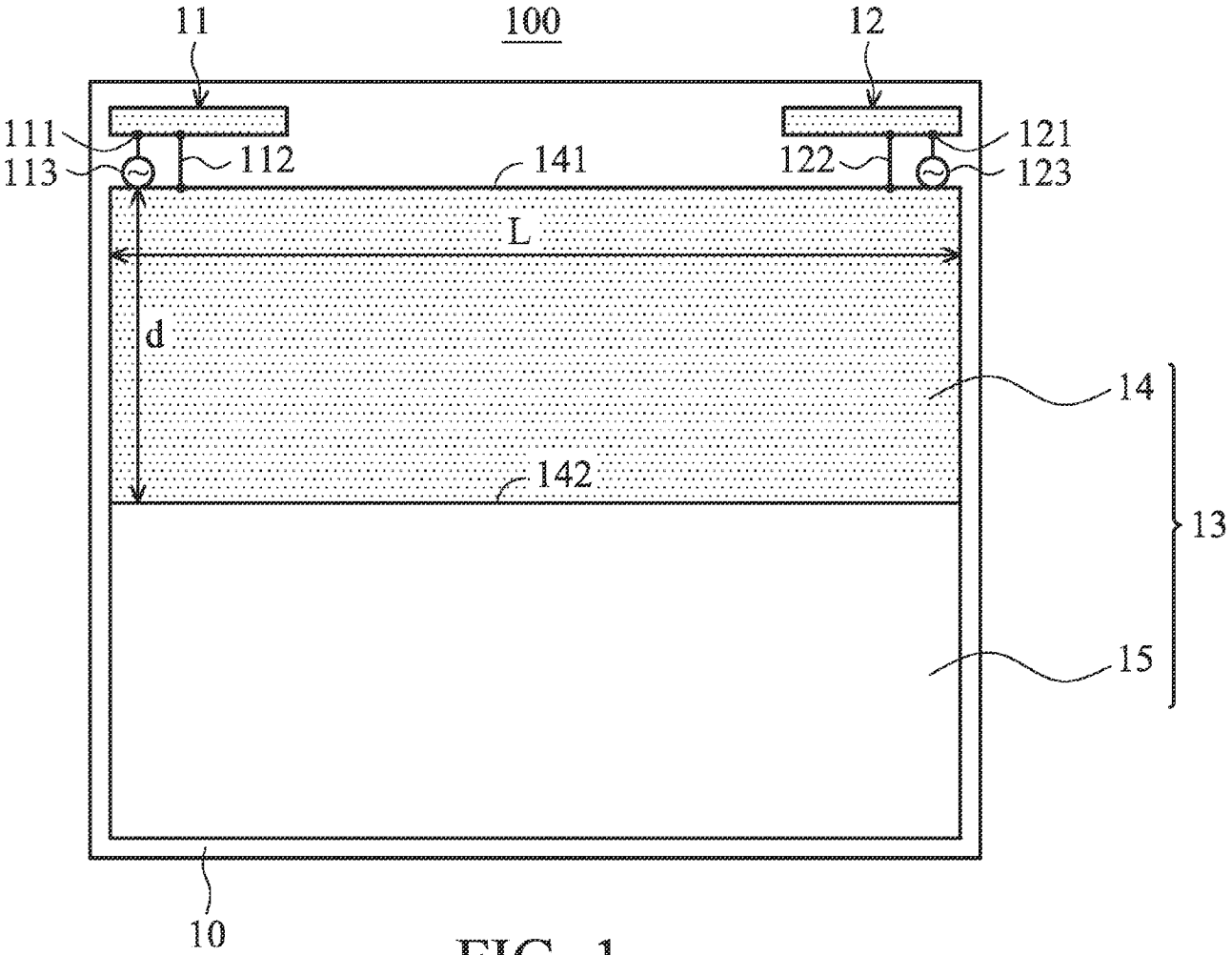
FIG. 1 is a diagram for illustrating a communication device according to a first embodiment of the invention.

FIG. 1 is a diagram for illustrating a communication device 100 according to a first embodiment of the invention. In the first embodiment, the communication device 100 comprises a first antenna 11, a second antenna 12, and a supporting plate 13. The first antenna 11 and the second antenna 12 form an antenna system. The supporting plate 13 comprises a conductive plate 14 and a non-conductive plate 15. The conductive plate 14 has a first edge 141 and a second edge 142, wherein the second edge 142 is opposite to the first edge 141, and the second edge 142 is adjacent to the non-conductive plate 15. The first antenna 11 has a feeding terminal 111 and a shorting line 112. A signal source 113 is a feeding signal source of the first antenna 11. The shorting line 112 is electrically coupled to the conductive plate 14, and the feeding terminal 111 is electrically coupled to the signal source 113. The second antenna 12 has a feeding terminal 121 and a shorting line 122. A signal source 123 is a feeding signal source of the second antenna 12. The shorting line 122 is electrically coupled to the conductive plate 14, and the feeding terminal 121 is electrically coupled to the signal source 123. The first antenna 11 and the second antenna 12 of the antenna system are both disposed at the first edge 141 of the conductive plate 14, and are substantially close to two opposite corners of the first edge 141, respectively. Each of the first antenna 11 and the second antenna 12 operates in at least a first band. The supporting plate 13 may be disposed on a back cover 10 of a tablet computer, or may be disposed on an upper cover of a notebook computer. The supporting plate 13 has enough robustness to protect the communication device 100 from large pressure. In the embodiment, the supporting plate 13 may comprise two hard materials to meet the requirement of protection. The conductive plate 14 is made of metal, such as aluminum magnesium alloy, and resistant to pressure. The non-conductive plate 15 is made of a hard non-conductive material, such as glass fiber reinforced plastic. With the compound materials, the supporting plate 13 has enough robustness, and the isolation between the first antenna 11 and the second antenna 12 increases. Note that the invention is not limited to the above. In other embodiments, the antenna system may comprise three or more antennas.

Figure 2A:
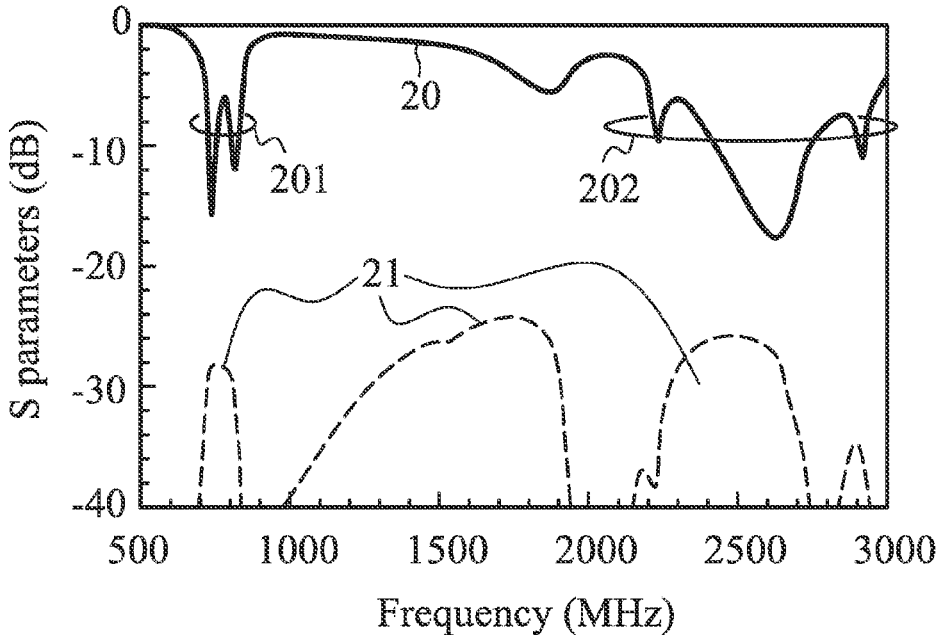
FIG. 2A is a diagram for illustrating S parameters of an antenna system of the communication device according to the first embodiment of the invention.
Figure 2B:
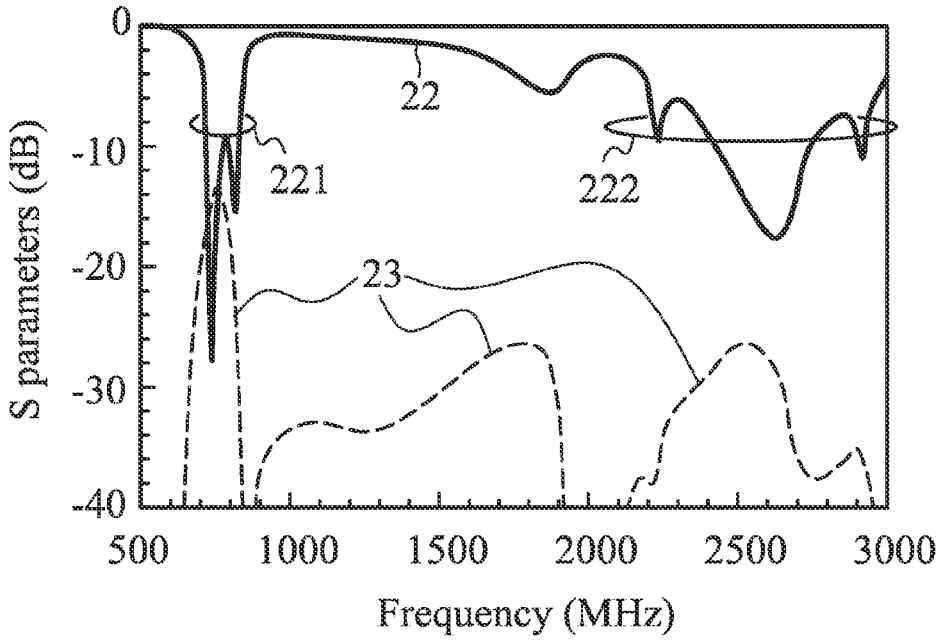
FIG. 2B is a diagram for illustrating S parameters of an antenna system of the communication device when the communication device uses a whole conductive plate.

Refer to FIGS. 2A and 2B together. FIG. 2A is a diagram for illustrating S parameters of the antenna system of the communication device 100 according to the first embodiment of the invention. In an embodiment, the length L of the first edge 141 of the conductive plate 14 is approximately equal to 260 mm, and the distance d between the first edge 141 and the second edge 142 is approximately equal to 110 mm, which is about 0.25 wavelength of the lowest frequency in a first band 201. According to the criterion of 6 dB return loss (design specification widely used for the internal antennas in mobile communication devices), the reflection coefficient (S11) curve 20 of the first antenna 11 of the antenna system comprises a first band 201 and a second band 202. In a preferred embodiment, the first band 201 covers the LTE 700 band (about from 704 MHz to 787 MHz), and the second band 202 covers the LTE 2300/2500 bands (about from 2300 MHz to 2400 MHz and from 2500 MHz to 2690 MHz). The invention is not limited to the above. A designer may adjust the first band 201 and the second band 202 by changing sizes and parameters of elements. In the first embodiment, the reflection coefficient (S22) curve of the second antenna 12 of the antenna system is similar to the reflection coefficient (S11) curve 20 of the first antenna 11, and also comprises the first band 201 and the second band 202. The reflection coefficient (S22) curve of the second antenna 12 will not be described again here. The antenna system in the first embodiment can be applied to MIMO operations of an LTE system, and the isolation (S21) curve 21 which represents the isolation (S21) between the first antenna 11 and the second antenna 12 is lower than −28 dB in the first band 201.

FIG. 2B is a diagram for illustrating S parameters of the antenna system of the communication device 100 when the communication device 100 uses a whole conductive plate. In the embodiment, the non-conductive plate 15 of the supporting plate 13 is replaced with another conductive plate. According to the criterion of 6 dB return loss, the reflection coefficient (S11) curve 22 of the first antenna 11 of the antenna system also comprises a first band 221 and a second band 222. The reflection coefficient (S22) curve of the second antenna 12 of the antenna system is similar to the reflection coefficient (S11) curve 22 of the first antenna 11, and comprises at least the first band 221 and the second band 222. The reflection coefficient (S22) curve of the second antenna 12 will not be described again here. In comparison to FIG. 2A, the isolation (S21) curve 23 of the antenna system in the embodiment merely reaches −13 dB, worse than −28 dB of that in the first embodiment. The invention uses the supporting plate 13 comprising compound materials, and sets the distance between the first edge 141 and the second edge 142 of the conductive plate 14 to be approximately equal to 0.25 wavelength of the lowest frequency of the first band 201. Accordingly, the supporting plate 13 not only has enough robustness but also improves the isolation (S21) in the first band 201 a lot. In a preferred embodiment, the isolation (S21) between the first antenna 11 and the second antenna 12 is lower than −28 dB in the first band 201, and is lower than −25 dB in the second band 202. The antenna efficiency of the first antenna 11 and the second antenna 12 is approximately from 40% to 55% in the first band 201 and is approximately from 60% to 88% in the second band 202 (the antenna efficiency includes the mismatching losses). Compared to the situation where the supporting plate 13 uses a whole conductive plate, the supporting plate 13 comprising compound materials in the first embodiment does not cause antenna efficiency to be decreased.

Figure 3:
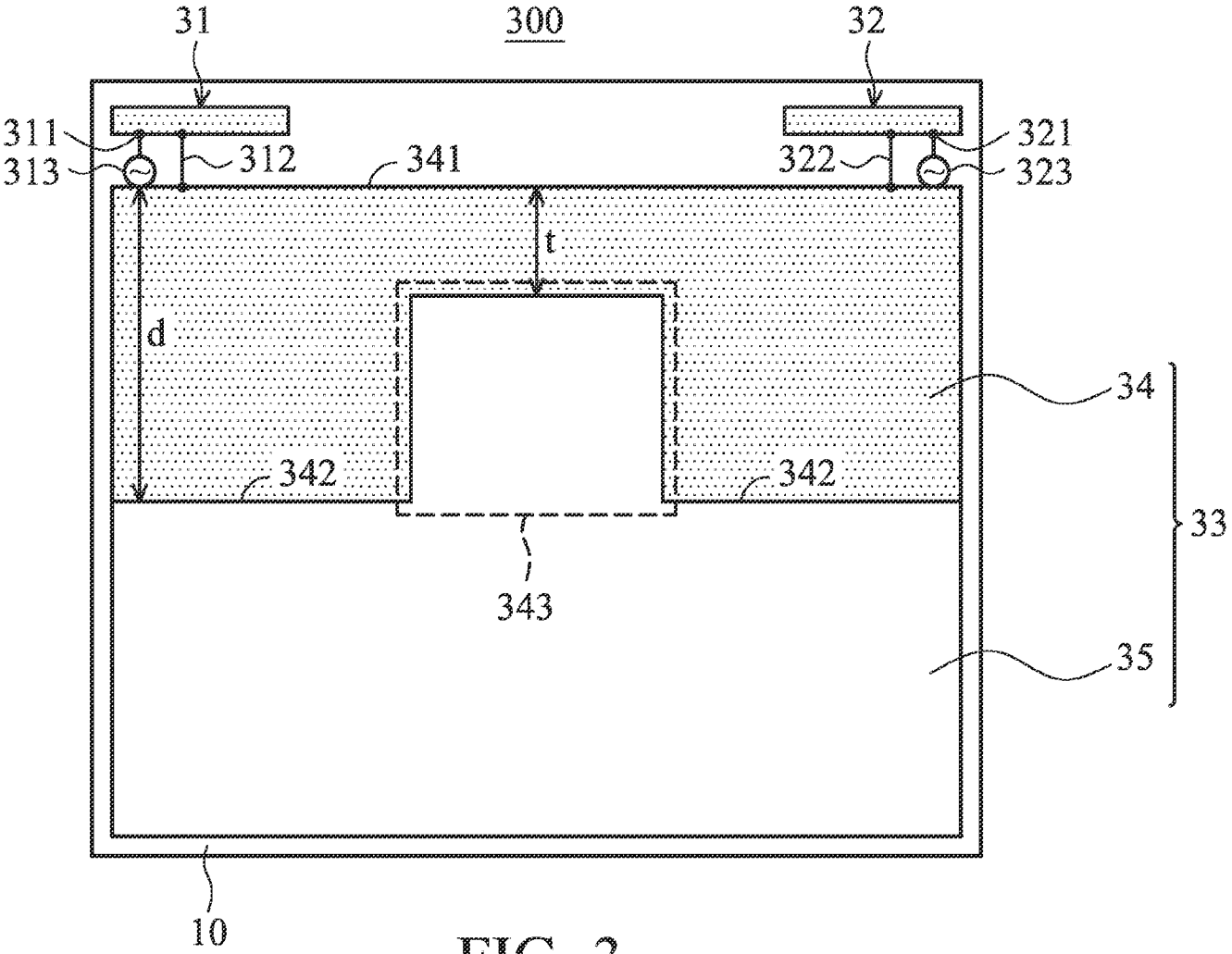
FIG. 3 is a diagram for illustrating a communication device according to a second embodiment of the invention.

FIG. 3 is a diagram for illustrating a communication device 300 according to a second embodiment of the invention. The structure in the second embodiment is generally similar to that in the first embodiment. In the second embodiment, a supporting plate 33 also comprises a conductive plate 34 and a non-conductive plate 35, and the conductive plate 34 has a first edge 341 and a second edge 342. The difference between them is that the conductive plate 34 of the communication device 300 in the second embodiment has a concave region 343 (or substantially a rectangular notch). The concave region 343 is located at the second edge 342 of the conductive plate 34. The distance t between the concave region 343 and the first edge 341 is smaller than the distance d between the first edge 341 and the second edge 342. In addition, the concave region 343 has a projection on the first edge 341, wherein the projection covers neither the first antenna 31 nor the second antenna 32. The first antenna 31 and the second antenna 32 form an antenna system. The first antenna 31 has a feeding terminal 311 and a shorting line 312. A signal source 313 is a feeding signal source of the first antenna 31. The second antenna 32 has a feeding terminal 321 and a shorting line 322. A signal source 323 is a feeding signal source of the second antenna 32. The first antenna 31 and the second antenna 32 of the antenna system are both disposed at the first edge 341 of the conductive plate 34, and are substantially close to two opposite corners of the first edge 341, respectively.

Figure 4:
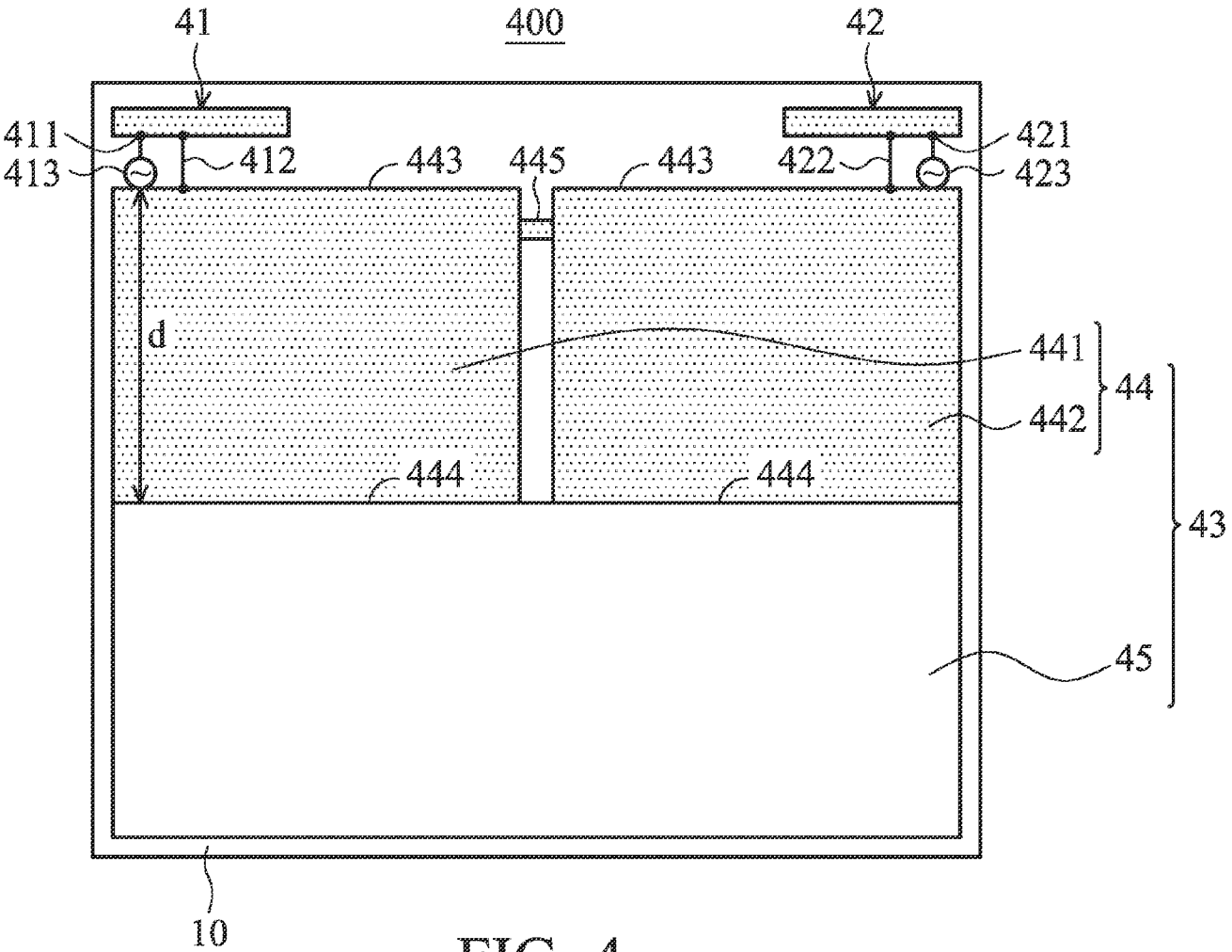
FIG. 4 is a diagram for illustrating a communication device according to a third embodiment of the invention.

FIG. 4 is a diagram for illustrating a communication device 400 according to a third embodiment of the invention. The structure in the third embodiment is generally similar to that in the first embodiment. In the third embodiment, a supporting plate 43 also comprises a conductive plate 44 and a non-conductive plate 45. The difference between them is that the conductive plate 44 comprises a first conductive portion 441 and a second conductive portion 442. The first conductive portion 441 is substantially separated from the second conductive portion 442. In addition, the first conductive portion 441 is further electrically coupled through a conductive element 445 to the second conductive portion 442. The conductive plate 44 has a first edge 443 and a second edge 444. The first antenna 41 and the second antenna 42 form an antenna system. The first antenna 41 has a feeding terminal 411 and a shorting line 412. A signal source 413 is a feeding signal source of the first antenna 41. The second antenna 42 has a feeding terminal 421 and a shorting line 422. A signal source 423 is a feeding signal source of the second antenna 42. The first antenna 41 of the antenna system is close to the first conductive portion 441, and the second antenna 42 of the antenna system is close to the second conductive portion 442. In addition, the first antenna 41 and the second antenna 42 of the antenna system are substantially close to two opposite corners of the first edge 443 of the conductive plate 44, respectively.

For the invention, the communication device 300 in the second embodiment and the communication device 400 in the third embodiment are all similar to the communication device 100 in the first embodiment. Accordingly, the performance of the second and third embodiments is similar to that of the first embodiment.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a supporting plate, comprising a conductive plate and a non-conductive plate, wherein the conductive plate has a first edge and a second edge, and the second edge is opposite to the first edge and is adjacent to the non-conductive plate, wherein the conductive plate does not overlap the non-conductive plate; and an antenna system, disposed at the first edge, and at least comprising:

a first antenna, operating in at least a first band; and a second antenna, operating in at least the first band, wherein a distance between the first edge and the second edge is approximately equal to 0.25 wavelength of the lowest frequency in the first band, and the distance is smaller than a length of the first edge.

2. The communication device as claimed in claim 1, wherein the first antenna and the second antenna are substantially disposed at two opposite corners of the first edge respectively.

3. The communication device as claimed in claim 1, wherein the conductive plate further comprises a concave region located at the second edge.

4. The communication device as claimed in claim 3, wherein a distance between the concave region and the first edge is smaller than the distance between the first edge and the second edge.

5. The communication device as claimed in claim 3, wherein the concave region comprises a projection on the first edge, and the projection covers neither the first antenna nor the second antenna.

6. The communication device as claimed in claim 1, wherein the supporting plate is disposed on a back cover of a tablet computer.

7. The communication device as claimed in claim 1, wherein the supporting plate is disposed on an upper cover of a notebook computer.

8. The communication device as claimed in claim 1, wherein the conductive plate comprises a first conductive portion and a second conductive portion, the first conductive portion is substantially separated from the second conductive portion, the first conductive portion is further coupled through a conductive element to the second conductive portion, the first conductive portion is close to the first antenna, and the second conductive portion is close to the second antenna.

9. The communication device as claimed in claim 1, wherein the antenna system further operates in a second band which is higher than the first band.

10. The communication device as claimed in claim 9, wherein the first band covers an LTE (Long Term Evolution) 700 band substantially from 704 MHz to 787 MHz, and the second band covers LTE 2300/2500 bands substantially from 2300 MHz to 2400 MHz and from 2500 MHz to 2690 MHz.

11. The communication device as claimed in claim 9, wherein isolation between the first antenna and the second antenna is lower than −28 dB in the first band and the second band.

12. The communication device as claimed in claim 1, wherein the conductive plate is made of aluminum magnesium alloy, and the non-conductive plate is made of glass fiber reinforced plastic, such that the supporting plate has enough robustness to protect the communication device from large pressure.

* * * * *